US008032972B2

(12) United States Patent
Cherry

(10) Patent No.: US 8,032,972 B2
(45) Date of Patent: Oct. 11, 2011

(54) PORTABLE, MULTI-PURPOSE GOLF APPARATUS

(76) Inventor: Janet Cherry, Riverdale, UT (US)

( * ) Notice: Subject to any disclaimer, the term of this patent is extended or adjusted under 35 U.S.C. 154(b) by 543 days.

(21) Appl. No.: 11/737,665

(22) Filed: Apr. 19, 2007

(65) Prior Publication Data

US 2007/0295359 A1 Dec. 27, 2007

Related U.S. Application Data

(60) Provisional application No. 60/745,128, filed on Apr. 19, 2006.

(51) Int. Cl.
*A63B 47/04* (2006.01)

(52) U.S. Cl. ..... 15/210.1; 15/104.001; 15/184; 15/105

(58) Field of Classification Search ..... 15/184, 15/104.001, 105, 210.1
See application file for complete search history.

(56) References Cited

U.S. PATENT DOCUMENTS

| | | | | |
|---|---|---|---|---|
| 2,701,378 | A * | 2/1955 | Dugan et al. | 15/111 |
| 3,378,873 | A | 4/1968 | Strout et al. | 15/244 |
| 4,350,457 | A | 9/1982 | Carnahan | 401/11 |
| 4,382,508 | A | 5/1983 | Robbins et al. | 206/216 |
| 4,854,449 | A | 8/1989 | Fitzhugh | 206/37 |
| 5,131,112 | A * | 7/1992 | Cervini | 15/209.1 |
| 5,333,343 | A * | 8/1994 | Nichols et al. | 15/106 |
| 5,339,483 | A * | 8/1994 | Byun | 15/184 |
| 5,419,477 | A | 5/1995 | Verge | 224/274 |
| D366,685 | S | 1/1996 | Faulk et al. | D21/234 |
| 5,590,773 | A | 1/1997 | Robinett | 206/315.1 |
| 5,829,086 | A | 11/1998 | Billek | 15/21.2 |
| 6,282,741 | B1 | 9/2001 | Manning | 15/104.94 |
| 6,695,509 | B1 | 2/2004 | Dowe, Sr. | 401/11 |
| 6,849,135 | B2 | 2/2005 | Jones | 134/6 |
| 6,883,989 | B2 | 4/2005 | Kushner et al. | 401/125 |
| 6,908,247 | B2 | 6/2005 | Gomez | 401/130 |
| 7,653,960 | B2 * | 2/2010 | Lee | 15/184 |
| 2001/0054211 | A1 * | 12/2001 | Cabedo-Deslierres et al. | 15/106 |
| 2004/0224121 | A1 * | 11/2004 | Sheppard, Jr. | 428/92 |
| 2005/0066987 | A1 * | 3/2005 | Perlman | 132/74.5 |

* cited by examiner

*Primary Examiner* — Shay Karls
(74) *Attorney, Agent, or Firm* — Kunzler Needham Massey & Thorpe

(57) ABSTRACT

An apparatus is disclosed providing a portable, multi-purpose golf apparatus. The apparatus includes a casing, a cleaning device, and an opening. The cleaning device may be extendable through the opening an effective distance to clean a golf ball. A carrier may be mounted to the cleaning device within the casing. The carrier may slide within the casing to transition the cleaning device from a stored position to an extended position. The golf apparatus may further include a positioning mechanism coupled to the carrier. The apparatus may include a second opening through which a divot tool or other supplemental device may be extendable.

16 Claims, 7 Drawing Sheets

PORTABLE, MULTI-PURPOSE GOLF APPARATUS

CROSS-REFERENCES TO RELATED APPLICATIONS

This application claims benefit of U.S. Patent Application No. 60/745,128 entitled "PORTABLE, MULTI-PURPOSE GOLF IMPLEMENT" and filed on Apr. 19, 2006 for Janet Cherry, which is incorporated herein by reference.

BACKGROUND OF THE INVENTION

1. Field of the Invention

This invention relates to portable golf equipment and more particularly relates to portable golf ball cleaners.

2. Description of the Related Art

Golf balls, by nature, contact the ground multiple times throughout the course of a golf game and can become soiled repeatedly, conceivably with each contact. The collected debris can adversely affect the flight of the ball and consequently, the player's overall game and score. Golfers are generally allowed to clean their golf ball once it reaches the green and before teeing it up on each hole. It is especially important that the ball is free of dirt and debris before putting, because if the ball is not clean, it cannot roll accurately to the hole, causing missed putts and a higher score.

To facilitate cleaning dirty golf balls, cleaning devices are commonly located next to each tee box. Large mechanical devices can be used to clean multiple balls at once and are generally effective for removing dirt. During a game, however, players rarely take the time and energy to run their golf ball through a complicated device before teeing it up. In addition, the cleaning devices are often fixed and require a certain amount of water supply to function properly. The water sometimes evaporates, or golf course maintenance crews fail to keep the devices filled with water, making it difficult for the golfers.

To clean balls during a game, golfers commonly use a damp towel or the equivalent. Wet towels that are carried to the green, however, often dampen surrounding objects and materials during transport and can be inconvenient. In addition, the towels tend to dry out during the course of a round. Consequently, golfers typically carry a dry towel, which is generally ineffective for cleaning hardened soil. The towels, both wet and dry, often fall off of the golf cart or get lost or misplaced. In the absence of a towel or suitable cleaning device, some golfers wipe off the debris onto their clothing, while others spit onto the ball or even lick it, which can present health risks, particularly due to the chemical fertilizers sprayed on the course and the greens.

SUMMARY OF THE INVENTION

From the foregoing discussion, applicant asserts that a need exists for a simple, portable cleaning device that can be easily transported and quickly used. Beneficially, such an apparatus would enable the golfer to effectively clean a soiled golf ball during play. The apparatus would provide the benefits of a wet towel, but would further provide a barrier to prevent the moisture from negatively affecting neighboring items or from evaporating. Furthermore, the apparatus would be easily stored such as in a pocket, clipped onto the waistband of the golfer's clothing, attached to a golf bag, or the like.

The present invention has been developed in response to the present state of the art, and in particular, in response to the problems and needs in the art that have not yet been fully solved by currently available golf equipment. Accordingly, the present invention has been developed to provide an apparatus and method for handling golf implements that overcome many or all of the above-discussed shortcomings in the art.

An apparatus is disclosed providing a portable, multi-purpose golf apparatus. The apparatus includes a casing retractably enclosing a cleaning device. The casing includes an opening and the cleaning device may be extendable through the opening an effective distance to clean a golf ball. A carrier may be mounted to the cleaning device within the casing. The carrier may slide within the casing to transition the cleaning device from a stored position to an extended position.

The golf apparatus may further include a positioning mechanism coupled to the carrier. The positioning mechanism may retract the cleaning device to a stored position in the casing and extend the cleaning device to an extended position through the casing opening. The cleaning device may be a fabric made of a micro fiber material. A slot may guide the positioning mechanism linearly along the slot. The apparatus may include a second opening through which a supplemental tool, such as a divot tool, may be extendable. The casing may also include a variety of accessories such as a ball marker.

A method is disclosed for enhancing a golf experience. The method includes providing a casing retractably enclosing a cleaning device and a carrier mounting the cleaning device within the casing. The cleaning device may be extendable through an opening of the casing a distance effective for cleaning a golf ball. The method may further include providing a magnetic accessory coupled to the casing and providing a ball marker magnetically attached to the magnetic accessory.

The method continues by detaching the ball marker from the magnetic accessory and picking up a golf ball and marking the golf ball position with the ball marker. The method concludes by extending the cleaning device and cleaning the golf ball, replacing the golf ball to the marked position, retracting the cleaning device, and reattaching the ball marker to the magnetic accessory.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to give a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1A:
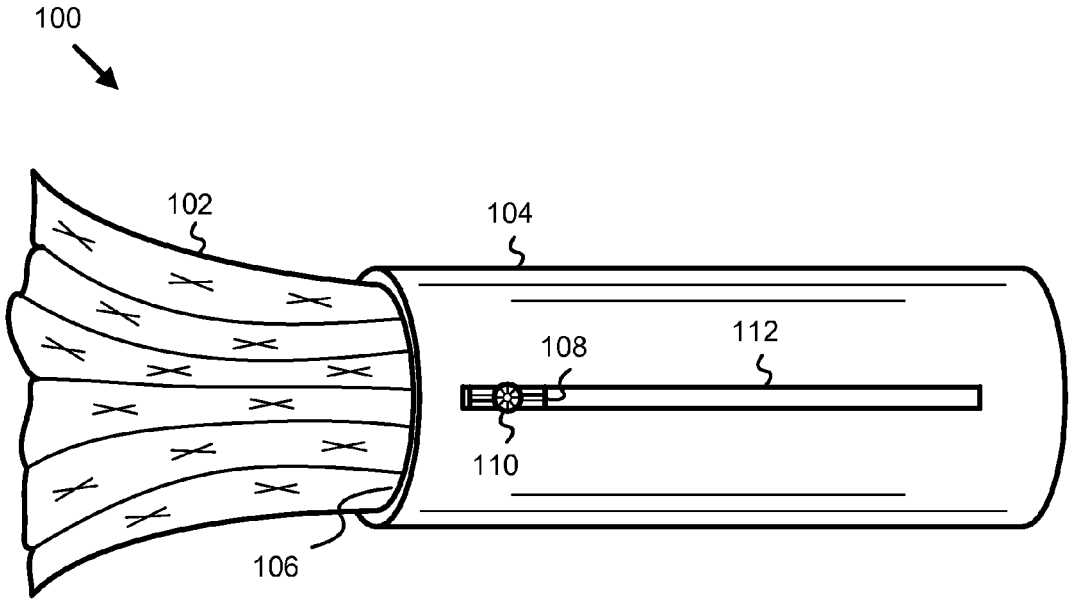
FIG. 1A is an illustration depicting one embodiment of a golf apparatus with an extended cleaning device in accordance with the present invention.

FIG. 1A is an illustration depicting one embodiment of a golf apparatus 100 with an extended cleaning device 102 in accordance with the present invention. The golf apparatus 100 may comprise a casing 104 retractably enclosing the cleaning device 102. The casing 104 may comprise a shape and/or other features, such as bumps or grips, facilitating the use of the casing 104 as a handle. Furthermore, the casing 104 may comprise an approximately sealable container separating the contents of the casing 104 from the exterior. For example, the casing 104 may protect a pair of pants from being wetted from the contents of the casing 104 when the casing 104 is placed in a pocket of the pants.

The casing 104 may be shaped as a circular cylinder, an oval cylinder, a polygonal cylinder, a rectangular box, or other shape suitable for enclosing the cleaning device 102. In one embodiment the casing 104 comprises an opening 106 such that the cleaning device 102 is extendable through the opening 106. The cleaning device 102 may extend through the opening 106 an effective distance to clean a golf ball.

In a contemplated embodiment, the casing 104 is compact and sized to fit into a pocket, holder, or the like. The casing 104 may be made of a variety of solid materials, including, but not limited to, plastic, anodized aluminum, steel, and aluminum. In addition, the casing 104 may also comprise one or more accessories such as a magnet, a ball marker, a loop, a chain, a hook, a clip, or the like. Some accessories may be useful for attaching the casing 104 to another object such as a belt, belt loop, key ring, golf bag, or the like.

The cleaning device 102 may comprise a cloth-like material suitable for removing debris from a golf ball such as a micro fiber towel. The cleaning device 102 may furthermore comprise a hook, a catch, a flap, a buttonhole, or other feature useful for mounting the cleaning device on a carrier 108. The cleaning device 102 may be shaped to be flat, to be bunched, to comprise a pouch, to be bell-shaped, or to be any shape desirable for a given application. In a contemplated embodiment the cleaning device 102 may be removable and interchangeable. Additionally, the micro fiber towel 102 may be dampened during use or dampened with a cleaning liquid such as water. The casing 104 may provide a liquid resistant barrier between the dampened cleaning device 102 and the exterior of the casing 104.

An alternate embodiment of the casing 104 may further include a second opening. A supplemental tool may be extendable through the second opening. For example, the cleaning device 102 may be stored in one chamber of the casing 104 and be extendable through the first opening 106, and the supplemental tool may be stored in a second chamber and be extendable through the second opening. Some examples of supplemental tools include a divot tool, a ball marker, a tee holder, a brush, a spotting scope, or a pocket knife. In one embodiment the opening 106 may be approximately sealed with a lid, cap, or other closable device (not shown). The golf apparatus 100 may further comprise the carrier 108 mounted to the cleaning device 102 within the casing 104. The carrier 108 may slide within the casing 104 transitioning the cleaning device 102 between a stored position (see FIG. 1B) and the extended position. In one embodiment the carrier 108 is releasable from the casing 104. For example, releasing the carrier 108 may permit changing the cleaning device 102.

The golf apparatus 100 may further comprise a positioning mechanism 110 coupled to the carrier 108. The positioning mechanism 110 may facilitate both the retracting of the cleaning device 102 to the stored position and the extending of the cleaning device 102 to the extended position. In one embodiment, a user supplies the mechanical force to move the positioning mechanism 110. In an alternative embodiment, a spring or other mechanism may facilitate the moving of the positioning mechanism 110.

The positioning mechanism 110 may consist of a knob 110, a protrusion 110, a spring-loaded mechanism 110, a button 110, or other device 110 suitable for positioning the carrier 108 within the casing 104. The knob 110 coupled to the carrier 108 may be guided by a slot 112 formed in the casing.

In one embodiment the slot 112 may guide the positioning mechanism 110 linearly along the slot. In an alternate embodiment the slot 112 may comprise a slot and/or other structure comprising notches and/or curves to direct the positioning mechanism 110 to specific positions along the slot 112. The slot 112 may comprise one or more slots 112 such that multiple devices may be retracted and extended from the casing 104.

Figure 1B:
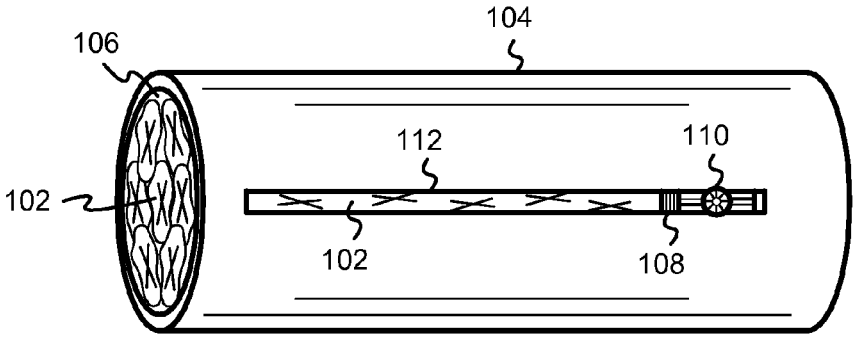
FIG. 1B is an illustration depicting one embodiment of a golf apparatus with a retracted cleaning device in accordance with the present invention.

FIG. 1B is an illustration depicting one embodiment of a golf apparatus 100 with a retracted cleaning device 102 in accordance with the present invention. The golf apparatus 100 comprises the cleaning device 102 shown in the stored position, the casing 104, the opening 106, and the carrier 108 mounted to the cleaning device 102. In the embodiment shown the carrier 108 may be slid linearly to the stored position. FIG. 1B further depicts the positioning mechanism 110 coupled to the carrier device 108 in the stored position and the slot 112 through which the cleaning device 102 may be visible. In alternate embodiments the cleaning device 102 may not be visible through the slot 112.

Figure 2A:
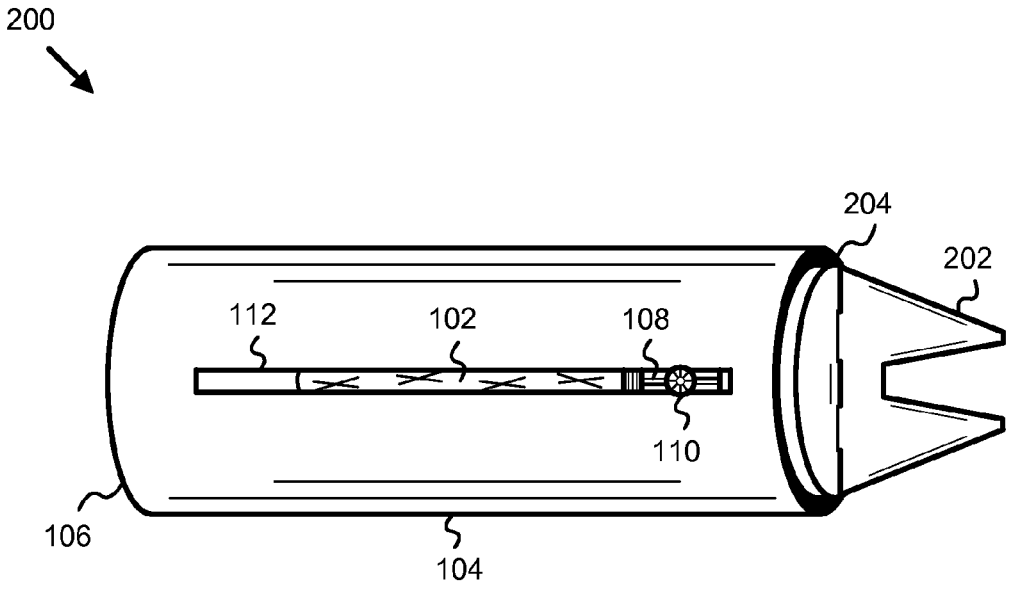
FIG. 2A is an illustration depicting one embodiment of a golf apparatus with an extended supplemental tool in accordance with the present invention.

FIG. 2A is an illustration depicting one embodiment of a golf apparatus 200 with an extended supplemental tool 202 in accordance with the present invention. The golf apparatus 200 comprises the opening 106 where the cleaning device 102, shown in the retracted position, may be extended. The golf apparatus 200 further comprises the second opening 204 where the supplemental tool 202 is extended. In the illustrated embodiment of the golf apparatus 200, the supplemental tool comprises a divot tool 202.

The supplemental tool 202 and the cleaning tool 102 may be coupled to opposing sides of the carrier 108 and may be transitioned linearly with the single positioning mechanism 110. For example, when the divot tool 202 is extended the cleaning device 102 is in a retracted position, and when the cleaning device 102 is extended the divot tool is in a retracted position. In an alternate embodiment the divot tool 202 and the cleaning device 102 may be extended and retracted independently by independent carriers 108 and independent positioning mechanisms 110.

Figure 2B:
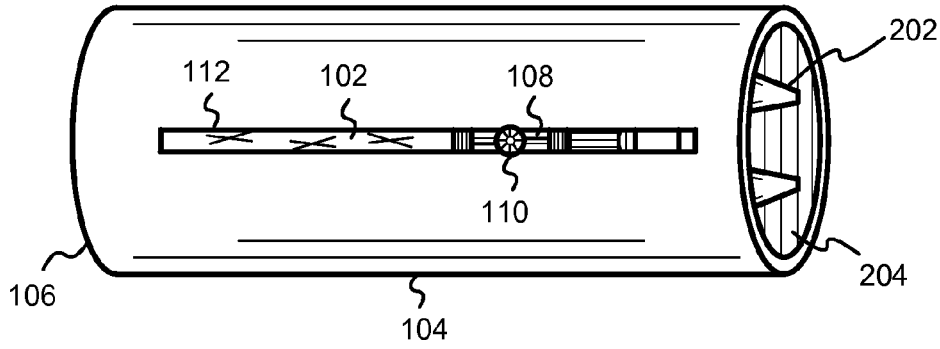
FIG. 2B is an illustration depicting one embodiment of a golf apparatus with a retracted supplemental tool in accordance with the present invention.

FIG. 2B is an illustration depicting one embodiment of the golf apparatus 200 with a retracted supplemental tool 202 in accordance with the present invention. The illustrated supplemental tool 202 of FIG. 2B is consistent with a divot tool 202 of FIG. 2A shown in a retracted position. The location of the positioning mechanism 110 illustrated corresponds to a fully retracted position, which in one embodiment indicates both the cleaning device 102 and the divot tool 202 are in a retracted position. The positioning mechanism 110 of the apparatus 200 may also extend the cleaning device 102.

Figure 3:
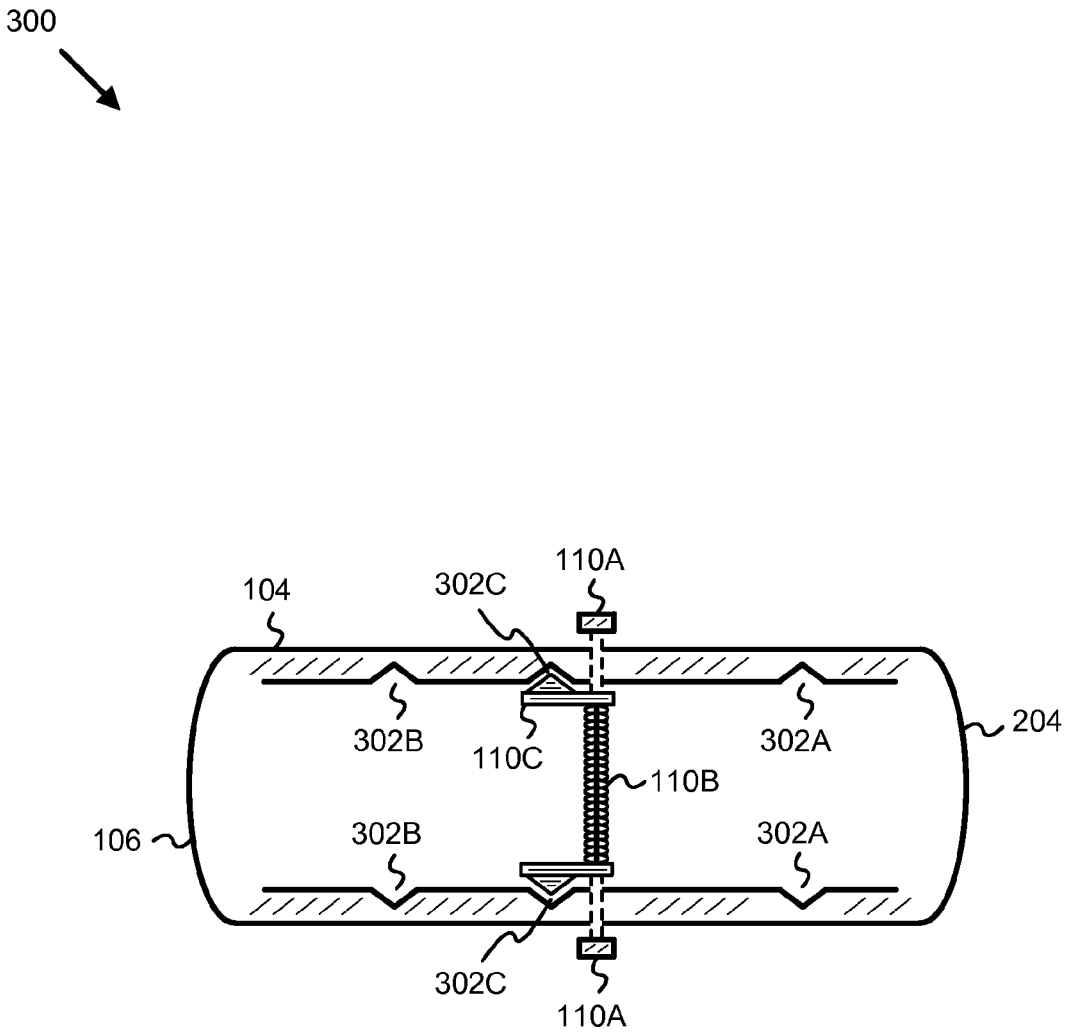
FIG. 3 is an illustration depicting one embodiment of a golf apparatus with a position regulator in accordance with the present invention.

FIG. 3 is an illustration depicting one embodiment of a golf apparatus 300 with a position regulator 302A, 302B, 302C in accordance with the present invention. The position regulator 302A, 302B, 302C may comprise recesses configured to guide the positioning mechanism 110A, 110B, 110C to configurable positions. In one embodiment the positioning mechanism 110A, 110B, 110C comprises a spring-loaded mechanism 110A, which may be coupled to a knob 110A, and recesses 302B, 302C, 302D at intervals along an interior wall of the casing 104. The positioning mechanism 110A, 110B, 110C may comprise one or more knobs 110A that may be pressed to facilitate the latching or fixing of the positioning mechanism 110A, 110B, 110C into the recesses 304A, 304B, 304C. In one embodiment the position regulator 302A, 302B, 302C directs the positioning mechanism 110A, 110B, 110C to three distinct positions comprising a cleaning device extended position (wherein the position mechanism tab 110C engages the recess 302A), a supplemental tool extended position (wherein the position mechanism tab 110C engages the recess 302B), and a fully retracted position (wherein the position mechanism tab 110C engages the recess 302C).

The position regulator 302A, 302B, 302C may comprise alternate embodiments including, without limitation, a position regulator having more positions or less positions than indicated in FIG. 3, and a position regulator with a multiplicity of positions and/or relatively continuously selectable positions. The spring-loaded mechanism 110B may comprise independent spring mechanisms 110B for moving the cleaning device 102 and a supplemental tool 202 independently. Furthermore, other mechanical methods of fixing the positioning mechanism 110 along the casing 104, such as cords, chains, pins, and elastomers are contemplated.

Figure 4A:
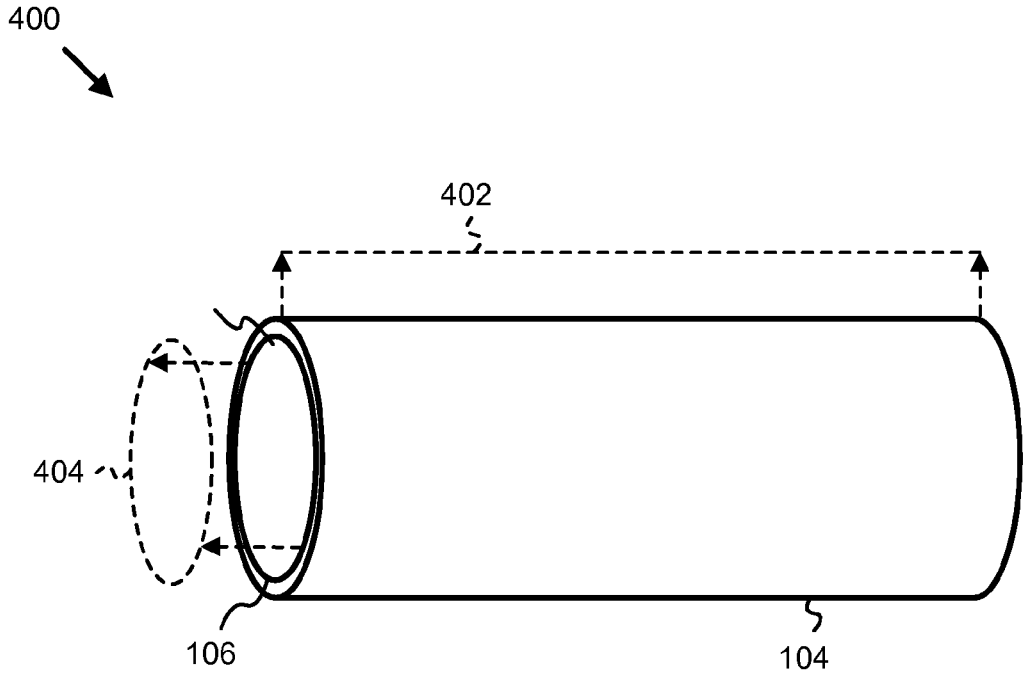
FIG. 4A is an illustration depicting one embodiment of a golf apparatus' casing dimensions in accordance with the present invention.

FIG. 4A is an illustration depicting one embodiment of a golf apparatus' casing dimensions 400 in accordance with the present invention. In one embodiment the length 402 of the casing 104 may be about 4.5 inches. The opening 106 may comprise a cross-sectional area 404 of about 1.2 square inches. The indicated dimensions have demonstrated utility as being convenient in a golfing environment, although other dimensions are contemplated within the scope of the invention.

Figure 4B:
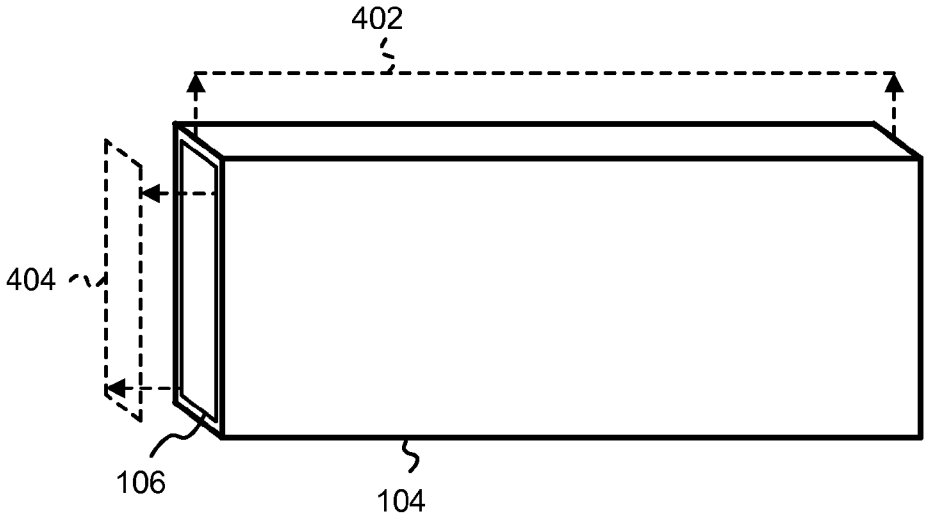
FIG. 4B is an illustration depicting another embodiment of a golf apparatus' casing dimensions in accordance with the present invention.

FIG. 4B is an illustration depicting one embodiment of a golf apparatus' casing dimensions 400 in accordance with the present invention. In one embodiment the length 402 of the casing 104 may be about 4.5 inches. The opening 106 may comprise a cross-sectional area 404 of about 1.2 square inches.

Figure 5:
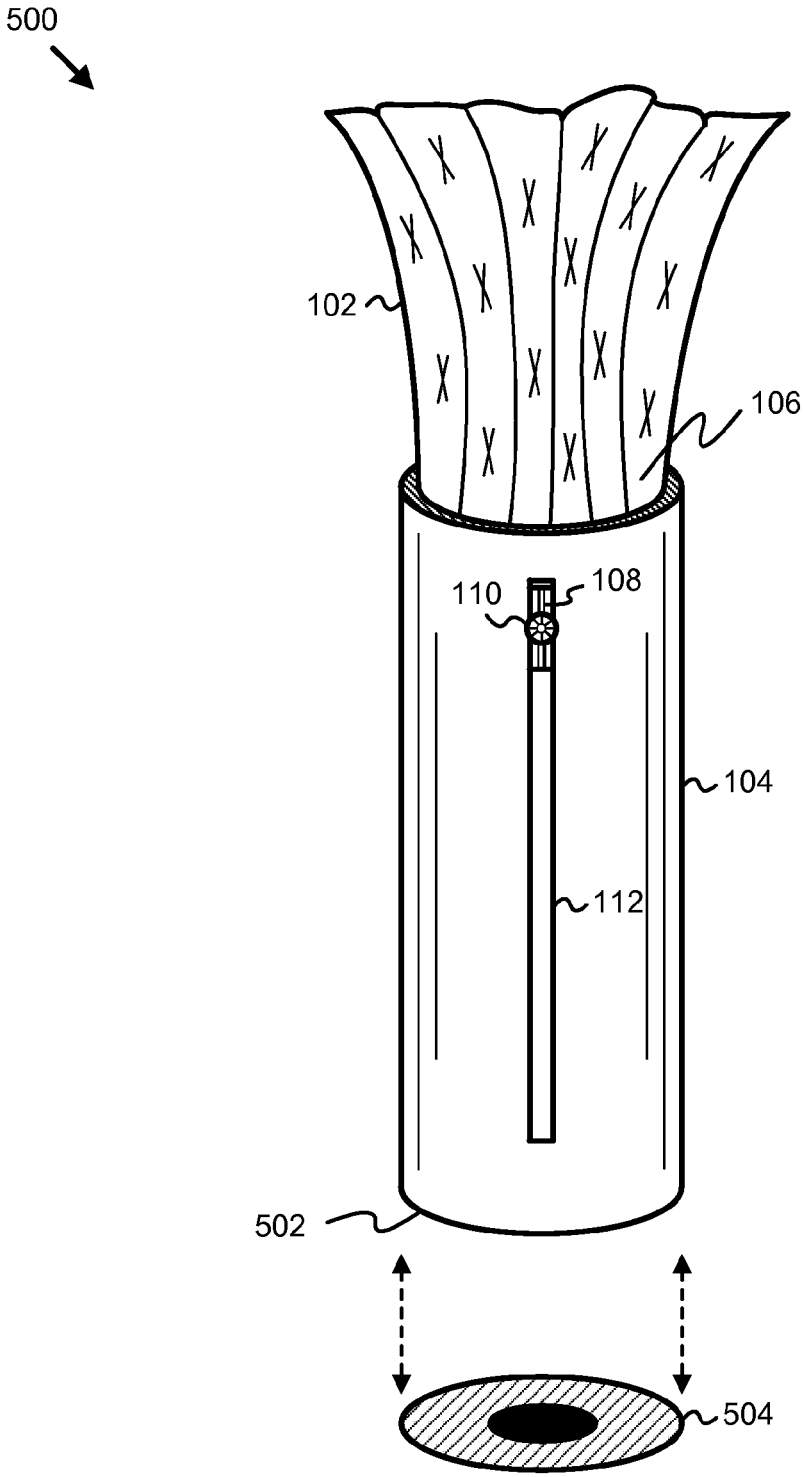
FIG. 5 is an illustration depicting one embodiment of a golf apparatus with a ball marker in accordance with the present invention.

FIG. 5 is an illustration depicting one embodiment of a golf apparatus 500 with a ball marker 502 in accordance with the invention. The ball marker 502 may be used to mark a position of a golf ball. In one embodiment the ball marker 502 marks the position of the golf ball while the golf ball is cleaned by the cleaning device 106.

Figure 6:
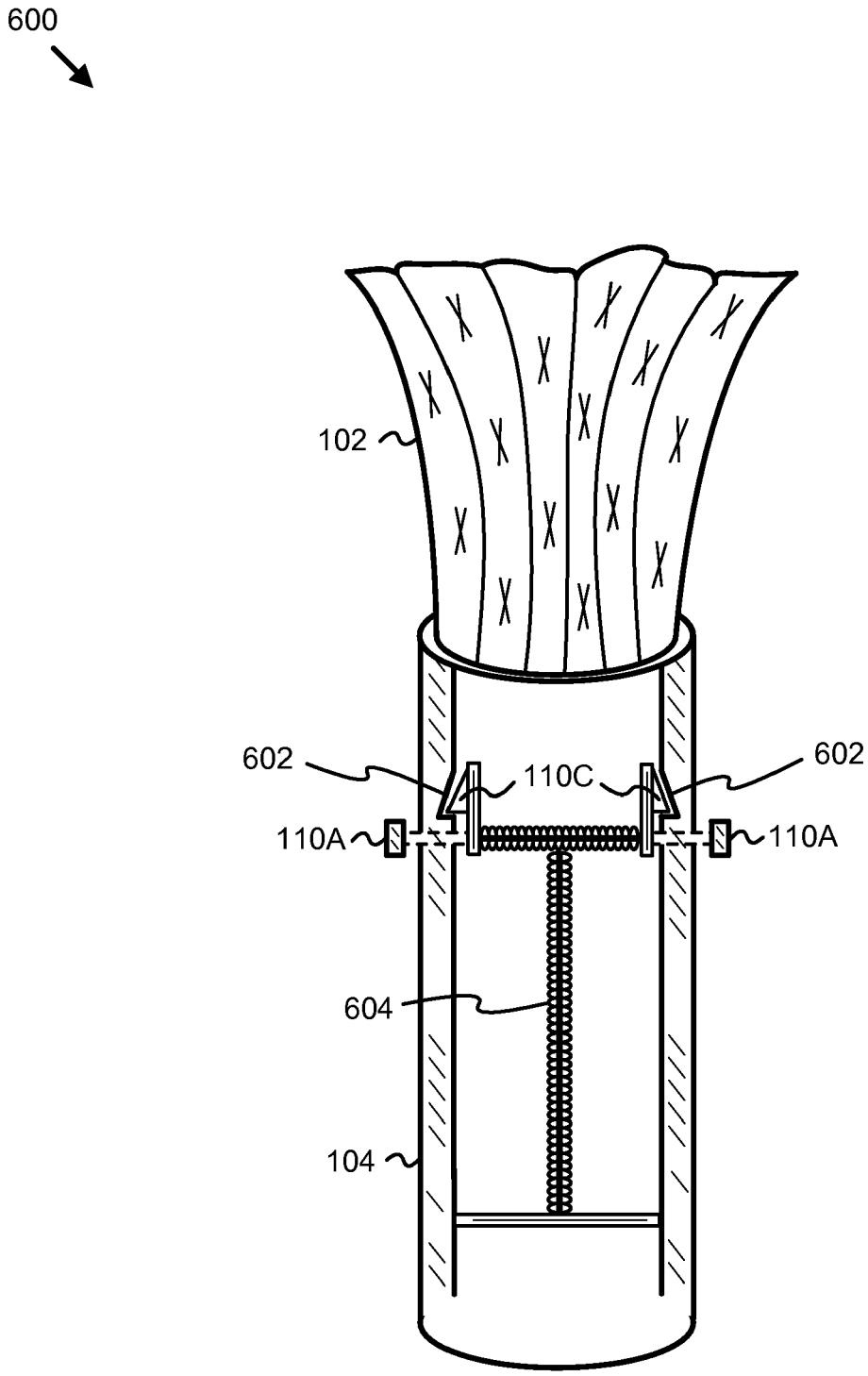
FIG. 6 is an illustration depicting one embodiment of an automatic retraction device in accordance with the present invention.

FIG. 6 is an illustration depicting one embodiment of an automatic retraction device 600 in accordance with the present invention. The automatic retraction device 600 automatically retracts the cleaning device 102. In one embodiment, the automatic retraction device 600 comprises notches 602 that engage the positioning mechanism tabs 101C such that when a user extends the cleaning device 102, the cleaning device 102 remains extended. When the user presses the knobs 110A, a spring 604 automatically retracts the cleaning device 102 into the casing 104. Other embodiments of an automatic retraction device 600 are understood by those of skill in the art and are contemplated within the scope of the present invention.

The schematic flow chart diagrams that follow are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 7:
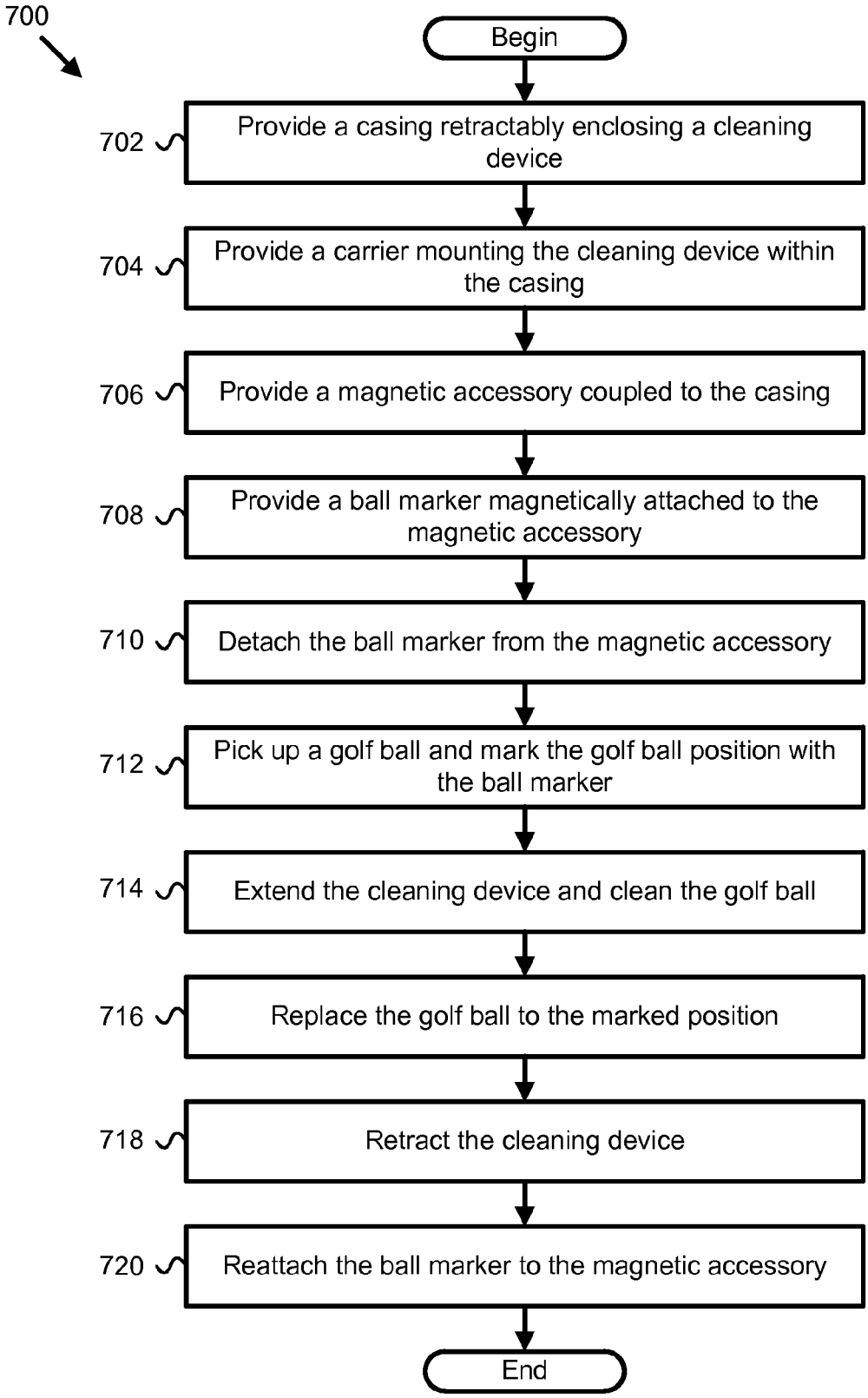
FIG. 7 is a schematic block diagram illustrating one embodiment of a method for cleaning a golf ball in accordance with the present invention.

FIG. 7 is a schematic block diagram illustrating one embodiment of a method 700 for cleaning a golf ball in accordance with the present invention. In one embodiment the method 700 comprises providing 702 a casing 104 retractably enclosing a cleaning device 102. The casing 104 may include an opening 106 where the cleaning device 102 may extend through. The method 700 further comprises providing 704 a carrier 108 mounting the cleaning device 102 with the casing 104. The carrier 108 may slide within the casing 104 linearly transitioning the cleaning device 104 from a stored position to an extended position.

The method 700 continues in one embodiment by 706 providing a magnetic accessory 502 coupled to the casing 104. The magnetic accessory 502 may be coupled to an end of the casing 104. The method 700 may further comprise providing 708 a ball marker 504 magnetically attached to the magnetic accessory 502, detaching 710 the ball marker 504 from the magnetic accessory 502, picking up 712 the golf ball and marking the golf ball position with the ball marker 504. The method 700 further includes extending 714 the cleaning device 102 and cleaning the golf ball, replacing 716 the golf ball to the marked position, retracting 718 the cleaning device 102, and finally reattaching 720 the ball marker 504 to the magnetic accessory 502.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A portable, multi-purpose golf apparatus comprising:

a casing retractably enclosing a cleaning device, the casing comprising an opening at an end thereof, wherein the cleaning device is extendable through the opening an effective distance to clean a golf ball;

a carrier mounted to the cleaning device within the casing, the carrier slidable within the casing to transition the cleaning device from a stored position to an extended position;

at least one positioning mechanism that laterally penetrates the casing through a side thereof and is coupled to the carrier, the at least one positioning mechanism retracting the cleaning device to the stored position and extending the cleaning device to the extended position; and a position regulator coupled to the at least one positioning mechanism inside the casing that fixes the carrier to a distinct position on an interior wall of the casing, the position regulator being concealed within the casing at the distinct position on the interior wall.

2. The apparatus of claim 1, wherein the at least one positioning mechanism can position the cleaning device in one or more intermediate positions between the stored position and the extended position.

3. The apparatus of claim 1, wherein the at least one positioning mechanism is selected from the group consisting of a knob, a protrusion, and a spring-loaded mechanism.

4. The apparatus of claim 1, wherein the cleaning device comprises fabric made of a micro fiber material.

5. The apparatus of claim 1, wherein the carrier is releasable from the casing, wherein the carrier comprises a mounting device configured to removably secure the cleaning device to the carrier.

6. The apparatus of claim 1, further comprising a slot formed in the casing, the slot guiding the at least one positioning mechanism such that the positioning mechanism is slid linearly along the slot.

7. The apparatus of claim 1, wherein the opening comprises a first opening, the casing further comprises a second opening at an opposite end of the casing, and wherein the cleaning device is extendable through the first opening, and a supplemental tool is extendable through the second opening.

8. The apparatus of claim 7, wherein the at least one positioning mechanism can be positioned to distinct positions consisting of a cleaning device extended position, a supplemental tool extended position, and a fully retracted position.

9. The apparatus of claim 7, wherein the supplemental tool is selected from the group consisting of a divot tool, a ball marker, a tee holder, a brush, and a spotting scope.

10. The apparatus of claim 1, further including an automatic retraction device that automatically retracts the at least one positioning mechanism to the stored position, wherein the automatic retraction device comprises positioning mechanism tabs connected to the positioning mechanism, knobs connected to the positioning mechanism tabs, and notches disposed on an interior surface of the casing, wherein the positioning mechanism tabs fit within corresponding notches to hold the positioning mechanism in the extended position until a user presses the knobs.

11. A portable, multi-purpose golf apparatus comprising:

a casing retractably enclosing a cleaning device, the casing comprising a first opening at an end thereof and a second opening at an opposite end thereof, wherein the cleaning device is extendable through the first opening an effective distance to clean a golf ball and a supplemental tool is extendable through the second opening;

a first carrier mounting the cleaning device within the casing, the first carrier slidable within the casing linearly transitioning the cleaning device from a stored position to an extended position;

a second carrier mounting the supplemental tool within the casing, the second carrier slidable within the casing linearly transitioning the supplemental tool from a stored position to an extended position, wherein the second carrier and the first carrier are independently slidable, such that the cleaning device and the supplemental tool can each be independently extended and stored;

a first positioning mechanism that laterally penetrates the casing through a side thereof and is coupled to the first carrier, the first positioning mechanism retracting the cleaning device to the stored position and extending the cleaning device to the extended position; and a second positioning mechanism that laterally penetrates the casing through a side thereof and is coupled to the second carrier, the second positioning mechanism retracting the supplemental tool to the stored position and extending the supplemental tool to the extended position;

a first position regulator coupled to the first positioning mechanism inside the casing that fixes the first carrier to a first distinct position on an interior wall of the casing, the first position regulator being concealed within the casing at the first distinct position on the interior wall; and a second position regulator coupled to the second positioning mechanism inside the casing that fixes the second carrier to a second distinct position on the interior wall of the casing, the second position regulator being concealed within the casing at the second distinct position on the interior wall.

12. The apparatus of claim 11, wherein the casing is about 4.5 inches in length, and has a cross-sectional area of about 1.2 square inches.

13. The apparatus of claim 11, wherein the casing comprises at least one material selected from the group consisting of plastic, anodized aluminum, steel, and aluminum.

14. The apparatus of claim 11 further comprising at least one accessory coupled to the casing, each accessory selected from the group consisting of a magnet, a ball marker, a loop, a chain, a hook, and a clip.

15. The apparatus of claim 11, wherein the second carrier further mounts the supplemental tool, wherein the supplemental tool comprises a member from the group consisting of a brush and a divot tool.

16. The apparatus of claim 11, wherein the second carrier further mounts the supplemental tool, wherein the supplemental tool comprises a member selected from the group consisting of a tee holder, a spotting scope, and a pocket knife.

* * * * *